United States Patent [19]

Tee

[11] Patent Number: 4,909,505

[45] Date of Patent: Mar. 20, 1990

[54] SELECTIVELY CONNECTABLE ELASTOMERIC EXERCISE APPARATUS

[76] Inventor: Virgil J. Tee, 104 Terrace Dr. No. 6, Atlanta, Ga. 30305

[21] Appl. No.: 259,343

[22] Filed: Oct. 18, 1988

[51] Int. Cl.[4] ..... A63B 21/04

[52] U.S. Cl. ..... 272/136; 272/137; 272/142; 272/900

[58] Field of Search ..... 272/93, 117, 118, 125, 272/126, 133, 135–143, 900

[56] References Cited

U.S. PATENT DOCUMENTS

| | | | |
|---|---|---|---|
| 1,969,165 | 8/1934 | Turner . | |
| 2,118,114 | 5/1938 | Schenk | 272/142 |
| 3,256,015 | 6/1966 | Perrin . | |
| 3,300,210 | 1/1967 | Melchiona | 272/125 |
| 3,355,171 | 11/1967 | Oesau | 272/125 |
| 3,415,515 | 12/1968 | Otto | 272/136 X |
| 3,652,085 | 3/1972 | Cole . | |
| 3,677,543 | 7/1972 | Richardson | 272/136 |
| 3,807,730 | 4/1974 | Dalton et al. . | |
| 3,966,204 | 6/1976 | Dubach | 272/135 |
| 4,023,808 | 5/1977 | Hebert | 272/137 |
| 4,027,876 | 6/1977 | Johnston | 272/133 |
| 4,059,265 | 11/1977 | Wieder et al. | 272/137 |
| 4,090,706 | 5/1978 | Reda | 272/137 |
| 4,121,825 | 10/1978 | Hult | 272/900 X |
| 4,195,835 | 4/1980 | Hinds et al. | 272/137 |
| 4,251,071 | 2/1981 | Norton | 272/137 |
| 4,428,578 | 1/1984 | Kirkpatrick | 272/143 X |
| 4,544,155 | 10/1985 | Wallenbrock et al. | 272/136 |
| 4,570,929 | 2/1986 | Shoemaker | 272/137 |
| 4,611,805 | 9/1986 | Franklin et al. | 272/136 |
| 4,733,862 | 3/1988 | Miller | 272/137 |
| 4,756,527 | 7/1988 | Ledbetter | 272/143 |
| 4,779,867 | 10/1988 | Hinds | 272/142 X |

FOREIGN PATENT DOCUMENTS

| | | | |
|---|---|---|---|
| 2917834 | 11/1980 | Fed. Rep. of Germany | 272/143 |

OTHER PUBLICATIONS

The Lifestyle Resource, "The Lifeline Gym", from the Media Development Group 1988, C82 Advertisement.

*Primary Examiner*—Richard J. Apley
*Assistant Examiner*—Robert W. Bahr

[57] ABSTRACT

At least one elastomeric tube formed in a loop with rings threaded on the loop to receive a connectable hand grip, a connectable foot strap, and a connectable door stop. The hand grip, the foot strap, and the door stop each include a woven fabric ribbon which threads through at least one elongate rigid tube, the ribbon connected at its ends to form a large loop to receive the rigid tube and a smaller second loop to receive a snap buckle. Various combinations of the elastic loops, the hand grip, the door stop, and the foot strap may be innerconnected to permit the exerciser to perform a variety of exercises to fully work out the upper body, the abdomen, and the legs.

11 Claims, 5 Drawing Sheets

SELECTIVELY CONNECTABLE ELASTOMERIC EXERCISE APPARATUS

TECHNICAL FIELD

The present invention relates to an apparatus for resistance exercise of an individual's muscle structure. More particularly, the present invention relates to an elastomeric exercise apparatus with selectively connectable accessories, including grip for hand and feet and a stop to pull against, permitting the individual to exercise specific selected muscles.

BACKGROUND OF THE INVENTION

Elastomeric exercise apparatus have been available for use by individuals in exercising, strengthening, and toning a persons muscle structure. Such apparatus use weights, cables, springs, and elastomeric tubes, among others, to create the resistance against which the individual stretches and works the muscles. U.S. Pat. No. 4,544,155 describes an exercise apparatus using a stretchable elastomeric tube. Such a tube is flexible and stretchable. Loops are formed in the ends of the tube and a pivotable snap hook connects through the loops to the ends of the tube. The snap hooks permit connecting the elastomeric tubing to a fabric band and a fixed connection, against which the user may pull. The fabric band may be wrapped around the arms or wrists of the user, or a larger fabric band may be wrapped around the user's waist.

Similarly, U.S. Pat. No. 4,733,862 describes an elastic resistance exerciser with a loop formed at each end of an elongated elastic member. A tubular handle fits on each loop and a self-locking slider moves on the elastic member to adjust the size of the loop.

U.S. Pat. No. 4,251,071 describes an exercising device made from an elongated elastic rod with a foot-receiving loop formed at each end. A hollow hand grip includes an axial bore and a longitudinally-extending split permitting one or two lengths of the elastic rope to be inserted into the bore. Squeezing the hand grip causes the wall of the bore to frictionally grip the rope, permitting exercise use of the device.

U.S. Pat. No. 1,969,165 describes an exercise device which is anchored by a closed door. A strap passes between the lower edge of a closed door and the floor, with a disc bearing on the door and floor to prevent the strap from being pulled from its position beneath the door.

U.S. Pat. No. 4,121,825 describes a portable foot anchor which engages the lower portion of a closed door. A woven nylon ribbon threads through longitudinally spaced slots in a tube and connects in the interior of the tube. The ribbon loop is extended under the bottom of a door with the tube in abutting contact with the lower portion of the closed door. The exerciser places his foot in the ribbon loop, and the tube provides an anchor against which the exerciser pulls.

U.S. Pat. No. 4,059,265 describes an elastic pull-type exercise which includes a thin elongated strap member 30 made from a resiliently deformable polymeric resinous material which can be attached at the juncture of a door and causing or jamb. An elastomeric cable threads through apertures on one end of the strap member.

These various apparatus have drawbacks which limit their usefulness for a wide-ranging program of exercises. Elastomeric cables provide resistance. As an exerciser continues to develop his muscles, the resistance level should increase to continue working the muscles but some of the existing apparatus cannot be adjusted. Those that can be adjusted may slip, or the user may not position the elastic cord for the appropriate resistance each time the equipment is used.

To perform upper body exercises, equipment different from that for leg or abdominal exercises is required. For a user to fully work out the muscles of the upper body, the abdomen, and the legs, the exerciser must have available specific apparatus for each of these muscle groups. For an exerciser who travels, carrying a variety of heavy equipment for a full complement of exercises takes up room in the baggage and the equipment contributes additional weight.

Thus, there exists a need in the art for elastomeric exercise apparatus free of the problems typically associated with known resistance exercise devices.

BRIEF DESCRIPTION OF THE INVENTION

The present invention solves the above-described problems with prior art exercise apparatus by providing a resistance-type exercise apparatus adaptable for a variety of body exercises.

Generally described, the present invention comprises selectively connectable gripping or holding devices and a resistance-loading, elastomeric loop against which an exercise may work to exercise muscles. The exercise combines the holding devices and the loop to selectively perform specific exercises for muscles of the upper body, the abdomen, and the legs.

Still, somewhat more specifically, the present invention provides a stretchable, elastomeric tube connected to form a loop, rings thread on the loop, a connectable hand grip, a connectable foot strap, and a connectable door stop. The hand grip includes a woven fabric ribbon which threads through an elongated rigid tube. The ribbon is connected at its end to form a large loop for the rigid tube and a smaller second loop. A snap buckle connects to the smaller loop and the snap buckle permits the hand grip to detachably connect to one ring on the elastomeric tube. The foot strap includes a woven fabric ribbon which connects together to form two loops. Threaded through each loop is a soft rubber tube. A snap buckle connects to the strap where the ends join together to define the loops and permits the foot strap to detachably connect to one ring on the elastomeric tube. The door stop uses a woven fabric ribbon to form a loop on which is threaded a rigid tube. The ends of the ribbon connect together to close the loop from the tube and to form a second smaller loop. A snap buckle secures to the smaller loop and permits the door stop to detachably connect to the other ring of the elastomeric tube. Various combinations of the elastic loops, the hand grip, the door stop and the foot strap may be assembled to permit a variety of exercises for the upper body, the abdomen, and the legs.

Accordingly, it is an object of the present invention to provide a lightweight, portable resistance-type exercise apparatus.

Another object of the present invention is to provide equipment selectively connectable to assemble different resistance-type exercise apparatus.

Yet another object of the present invention is to provide a resistance exercise which may be increased in resistance capacity.

Other objects features and advantages of the present invention will become apparent upon reading the following detailed description of the disclosed embodiment in conjunction with the appended drawings and claims.

DETAILED DESCRIPTION OF THE PREFERRED EMBODIMENTS

Figures 1A, 1B, 2:
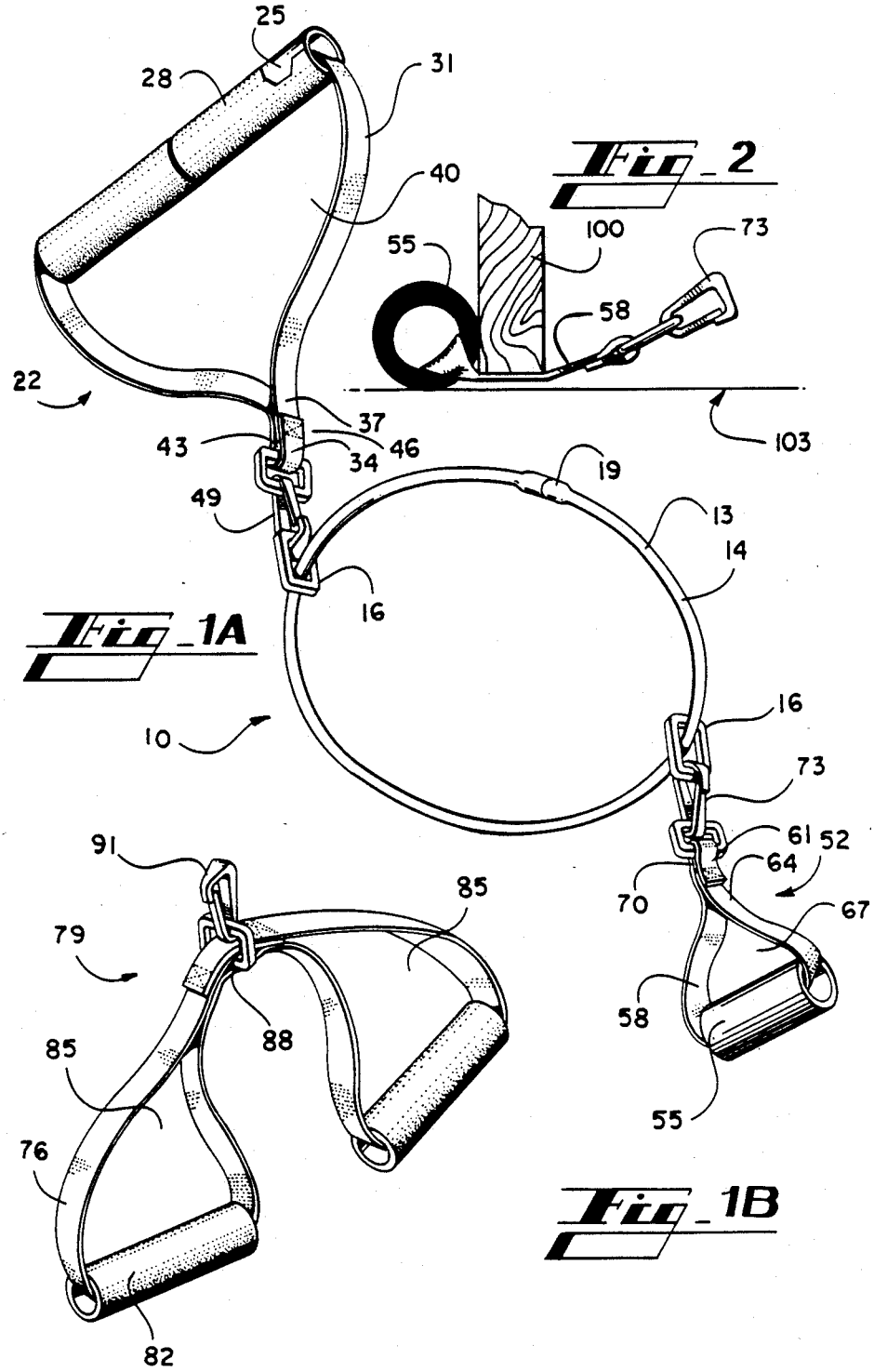
FIG. 1A is a perspective view of a disclosed embodiment of the selectively connectable elastomeric exercise apparatus according to the present invention.
FIG. 1B is a perspective view of a disclosed embodiment of a foot strap selectively connectable to the elastomeric exercise apparatus illustrated in FIG. 1A.
FIG. 2 is a side view of a door with the disclosed embodiment of a door stop according to the present invention illustrated in FIG. 1A.

Referring now in more detail to the drawings, in which like numerals indicate like parts throughout the several views, FIG. 1A illustrates in perspective view a disclosed embodiment of the selectively connectable elastomeric exercise apparatus 10 according to the present invention. The exercise apparatus 10 includes accessories which connect to a loop 14 made from an elastomeric tube 13. A pair of rings 16 thread on the tube 13 prior to forming the loop 14. A rigid tube 19 receives and joins together the ends of the elastomeric tube 13. The tube 19 preferably has an outer diameter bigger than the inner diameter of the tube 13. In an alternate embodiment, the ends of the tubes 13 bond together with an adhesive.

A hand grip 22 is one of several connectable accessories which comprise the elastomeric exercise apparatus 10. The hand grip 22 includes an elongate rigid tube 25 covered by a buffed foam rubber grip tube 28. A fabric ribbon 31 threads through the tube 25. One end 34 of the ribbon 31 wraps over opposite surfaces of the other end 37 to define a first large loop 40 for the tube 25 and a second smaller loop 43. The ends 34 and 37 of the ribbon 31 connect together at their points of adjacency 46. A snap buckle 49 connects to the smaller loop 43.

A door stop 52 includes a second rigid tube 55. The tube 55 preferably is shorter than the tube 25 but preferably has a larger diameter than the tube 25. A second fabric ribbon 58 threads through the tube 55. One end 61 of the ribbon 58 loops over the other end 64 to form a first loop 67 for the tube 55 and a smaller loop 70. A second snap buckle 73 connects to the door stop 52 by connecting to the ribbon end 61 which defines the small loop 70.

A third fabric ribbon 76 is used to make a double loop foot strap 79 illustrated in FIG. 1B. The ribbon 76 threads through a pair of resilient tubes 82 and double backs across itself, forming two larger loops 85 and a smaller loop 88. Each loop 85 receives one of the resilient tubes 82 which preferably are not as long as the tube 25. A snap buckle 91 connects to the ribbon 76 at the smaller loop 88. In an alternate embodiment (not illustrated), the foot strap has only a single loop with one resilient tube and a second small loop for the snap buckle. This embodiment is similar to the hand grip 22 or the door stop 52. Some exerciser may prefer this embodiment of the foot strap for certain exercises to avoid having the second foot strap loop dangling or flapping during the exercise movement.

Turning now to FIG. 2, there is illustrated a side view of a door 100 with a disclosed embodiment of the door stop 52 placed on the floor 103 adjacent the bottom of the door 100. The ribbon 58 threads under the door 100 and the stop 52 is pulled perpendicular to the door to position the tube 55 of the stop 52 adjacent the lower end of the door 100. The snap buckle 73 extends away from the door 100 on the side opposite to the tube 55.

Figures 3A, 3B, 3C, 3D:
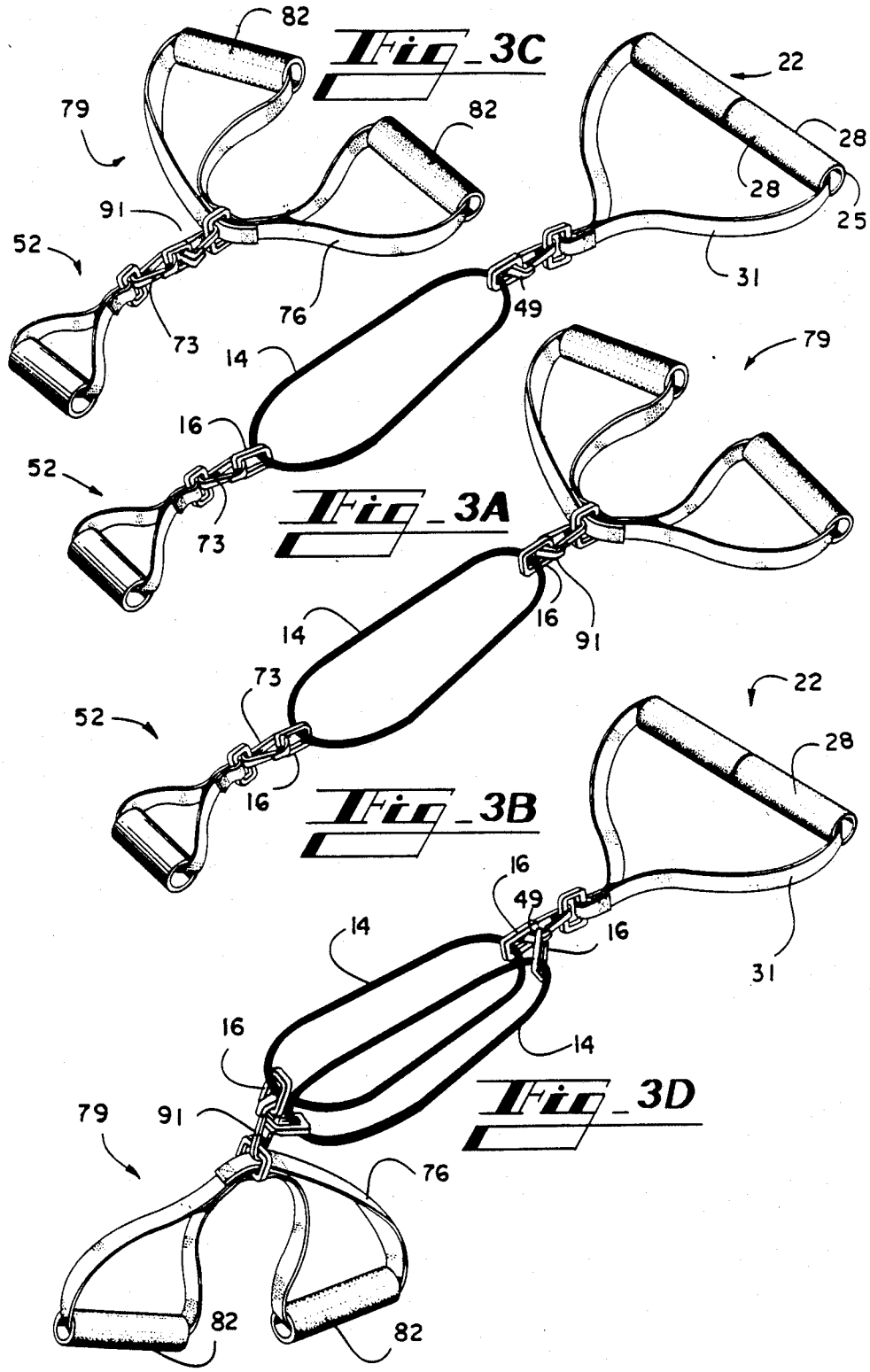
FIG. 3A is a perspective view of an alternate configuration having the door stop, the elastomeric loop, and the hand grip for the disclosed embodiment of the exercise apparatus illustrated in FIG. 1A.
FIG. 3B is a perspective view of an alternate configuration having the door stop, the elastomeric loop, and the foot strap for the disclosed embodiment of the exercise apparatus illustrated in FIGS. 1A and 1B.
FIG. 3C is a perspective view of an alternate configuration having the door stop and the foot strap for the disclosed embodiment of the exercise apparatus illustrated in FIGS. 1A and 1B.
FIG. 3D is a perspective view of an alternate configuration having the foot strap, a pair of elastomeric loops, and the hand grip for the disclosed embodiment of the exercise apparatus illustrated in FIGS. 1A and 1B.

As was previously discussed, the elastomeric exercise apparatus 10 according to the present invention permits selectively connecting the hand grip 22, the door stop 52, and the foot strap 79 to the elastomeric tube loop 14 with the rings 16 and the snap buckles 49, 73, and 91. FIGS. 3A–D provide perspective views of several configurations of the elastomeric exercise apparatus components discussed above. FIG. 3A is a perspective view of an alternate configuration having the door stop 52, the elastomeric loop 14, and the hand grip 22. The snap buckle 73 of the door stop 52 and the snap buckle 49 of the hand grip 22 clip to the rings 16.

FIG. 3B is a perspective view of another alternate configuration having the door stop 52, the elastomeric loop 14, and the double loop foot strap 79. The snap buckle 73 of the door stop 52 and the snap buckle 91 of the foot strap 79 each couple to separate rings 16 on the elastomeric loop 13.

FIG. 3C is a perspective view of still another alternate configuration having the door stop 52 attached directly to the foot strap 79 with the snap buckles 73 and 91 clipped to an intermediate ring similar to the ring 16. In an alternate embodiment, the snap buckles 73 and 91 clip together directly.

FIG. 3D is a perspective view of yet another alternate configuration having the foot strap 79, a pair of elastomeric loops 14, and the hand grip 22 connected together.

To use the elastomeric exercise apparatus 10 of the present invention, the exercise determines the exercise to be performed and assembles the appropriate components of the apparatus. Although the exercise apparatus may be connected by the door stop 52 to a closed door, the exercise apparatus alternatively may be connected to a permanent wall bracket (not illustrated). The door stop 52 acts as a securing device to which the other components attach. The ribbon 58 of the door stop 52 slips under the door 100 as illustrated in FIG. 2; pulling the ribbon 58 perpendicularly away from the door brings the tube 55 to bear against the side of the closed door. It is preferred that the door stop 52 be positioned to bear against the hinged side of the door 100 to prevent the door from swinging toward the exerciser, in the event that another person opens the door during exercise. In a preferred embodiment, the stop tube 52 is a polyethylene rigid tube approximately 2 inches long with a one and one-half inch outer diameter and that the door stop be secured to the bottom or top of a sturdy door with a clearance of less than approximately one inch. Also, a preferred embodiment uses a one-inch wide nylon webbing for the ribbons 31, 58, and 76.

With continued reference to FIGS. 1A and 1B, the loop 14 of the elastomeric exercise apparatus 10 preferably is natural latex tubing 13 having either a 5/16 inch inner diameter or a ¼ inch inner diameter. Given an equal length of tube, the larger inner diameter generally provides a greater resistance than the smaller diameter tube. Also, longer lengths of latex tubing have greater elasticity than shorter lengths. Various lengths and sizes of the latex tube may be formed into loops to provide a range of resistance for the exercise apparatus 10. It is preferred that stretching the latex loop 14 not exceed three times the original length. As previously explained, the tubing 13 is formed into a loop 14 by connecting a rigid tube 19 to the ends of the tube. In a preferred embodiment, the tube 19 is made of polyethylene, is approximately three inches long and has an outer diameter greater than that of the tube 13. The tube 19 is installed by applying a coat of rubbing alcohol on the outer surface of the tube. This permits sliding the rigid tube 19 into the flexible tube 13. The alcohol also keeps oil off the connector 19. After a brief period of time, the alcohol evaporates and the elastomeric tube 13 is connected fastly to the connector tube 19. An alternate embodiment bonds together the ends of the tube 13 with an adhesive.

The tube 25 of the hand grip 22 in the illustrated embodiment is approximately 10 inches long, with an approximate diameter of one inch and a wall thickness of approximately ⅛ inch. The tube 25 preferably is made from a material such as polyethylene which bends under pressure but does not shatter.

The tubes 82 of the foot strap 79 are preferably made from a resilient material such as rubber. The tubes 82 have a shorter length than the tube 25.

The illustrated embodiment includes rings 16 which are substantially rectangular in side view. The transverse gap between the longer members of each ring preferably is less than the diameter of the tube 13. The ring 16 thus moves relatively freely along the tube 13 when the tube is pinched together adjacent the ring. Otherwise, movement of the ring 16 is inhibited by the friction between the latex tube 13 and the ring. In a preferred embodiment, the rings are made of a high-strength shatter resistant material such as acetal plastic or nylon.

The snap buckles 49, 73, and 91 of the illustrated embodiment are fixed snap buckles which do not pivot. A preferred snap buckle is made of a high strength shatter resistant material such as acetal plastic or nylon.

Selectively connecting the door stop 52, the foot straps 79 or the hand grip 22 to one or more elastomeric tube loops 14 (such as illustrated in FIG. 3D) permits the exerciser to perform a variety of exercises to strengthen and tone specific muscle groups. Such exercises of the upper body, legs and abdomen should be performed in a slow, steady and sustained movement with a static hold at the extended point of each exercise. Sufficient pre-exercise warm up and post-exercise cool down should be practiced. An increase in resistance and repetitions should occur after the exercise program becomes easy.

Figure 4A:
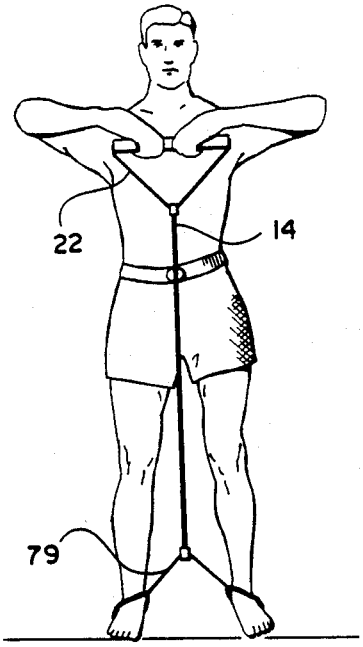
FIG. 4A is a view illustrating use of the configuration similar to that shown in FIG. 3D of the disclosed embodiment of the present invention for use in exercising upper body muscles.

Turning now to FIG. 4A, there is illustrated an upright rowing exercise using the foot strap 79, the elastomeric loop 14 and the hand grip 22 connected similarly as shown in FIG. 3D. (As explained previously, the alternate embodiment illustrated in FIG. 3D includes two elastomeric loops 14 which increase the resistance of the assembled apparatus.) The feet push downwardly against the tubes 82 of the foot strap 79. The exercise raises his arms and pulls on the tube 25 of the hand grip 22. Such upright rowing exercises the shoulders and the upper back.

Figure 4B:
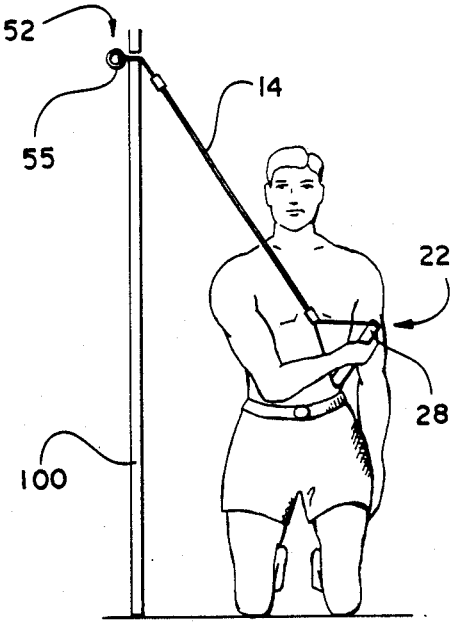
FIG. 4B is a view illustrating use of the configuration shown in FIG. 3A of the disclosed embodiment of the present invention for use in chest muscle exercise.

FIG. 4B illustrates a chest exercise being performed with a configuration of the exercise apparatus 10 having the door stop 52, the elastic hoop 14, and the hand grip 22 as illustrated in FIG. 3A.

The door stop 52 passes over the top of the closed door 100. The illustrated fly exercise for chest muscles requires that the exercise kneel with his side to the door. The hand bar 22 is firmly grasped with the arm fully extended to the side. The bar 22 is slowly pulled across the chest while keeping the elbow slightly bent. The exerciser then returns his arm slowly to the starting position. This exercise may be repeated for the other side.

Positioning the door stop 52 at the top of the door 100 also permits exercising the tricep muscles. The exercise stands facing the door with the bar 22 firmly grasped with a palms-down grip. The bar is slowly pulled downward without bending the elbows, and returned to the starting position.

Figure 4C:
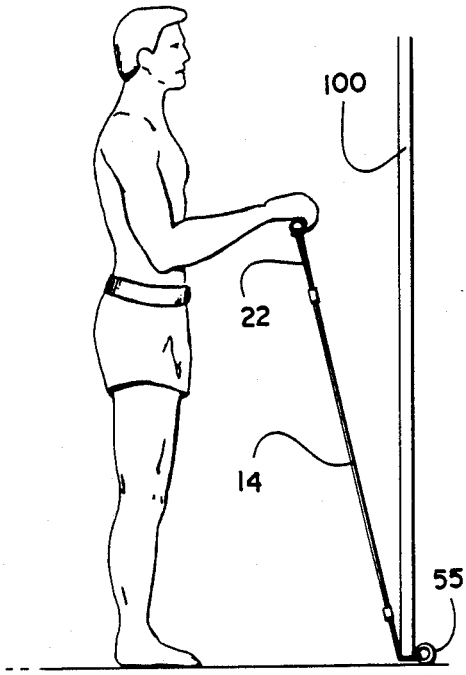
FIG. 4C is a view illustrating use of the configuration shown in FIG. 3A of the disclosed embodiment of the present invention for use in shoulder exercise.

Other upper body exercises may be performed with the apparatus configuration of 3A, as further illustrated in FIG. 4C. These exercises include the curl for exercising the bicep muscles, the reverse curl for exercising the biceps and forearms, and the forward raise for exercising the shoulders. The door stop 52 is secured by the bottom of the door 100 as described previously. The curl exercise is accomplished with a palms-up grip on the bar 22. The exerciser slowly curls the bar 22 to the upper chests, and slowly returns to the starting position. The reverse curl is a similar exercise for the biceps and forearms, but the bar 22 is grasped with a palmsdown grip. For exercising the shoulders, the forward raise exercise requires that the arms be extended straight and kept straight while the bar is raised to head height. For this exercise, the bar 22 is grasped with the palms down.

Figure 4D:
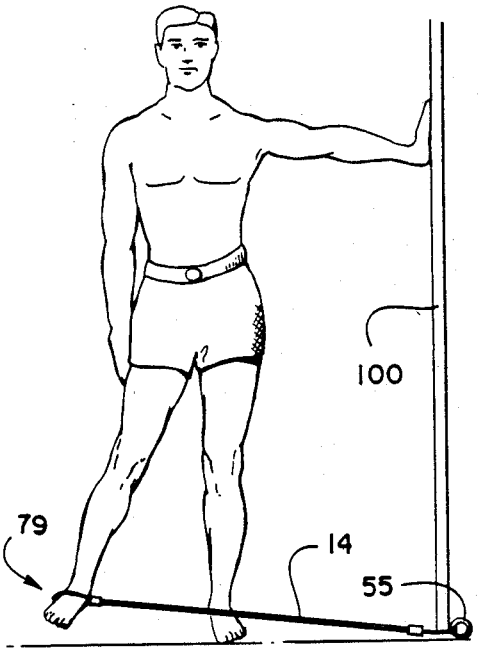
FIG. 4D is a view illustrating use of the configuration shown in FIG. 3B of the disclosed embodiment of the present invention for use in thigh exercise.

The elastomeric exercise apparatus 10 of the present invention may also be used to exercise the muscles of the leg. FIGS. 4D, E, and F illustrate several exercises which may be accomplished using the foot strap 79, the elastomeric loop 14, and the door stop 52, although the hand grip 22 could be used for some exercises instead of the foot strap 79. The door stop 52 is secured to the bottom of the door 100 for these leg exercises. FIG. 4D illustrates the side kick for exercising the inner and outer thigh. If necessary a chair may be used for balance. The ankle is secured through the loop 85 of the foot strap 79. The exerciser stands sideways to the door and holding a chair with a wall for balance slowly across the leg in front of the supporting leg and returns to the starting position. To exercise the outer thigh, the exerciser turns around and faces the opposite way. Starting with the leg crossed in front, the leg is slowly moved to uncross in front of the supporting leg and then slowly returned to the starting position. These exercises may be repeated for the other leg as well.

Figure 4E:
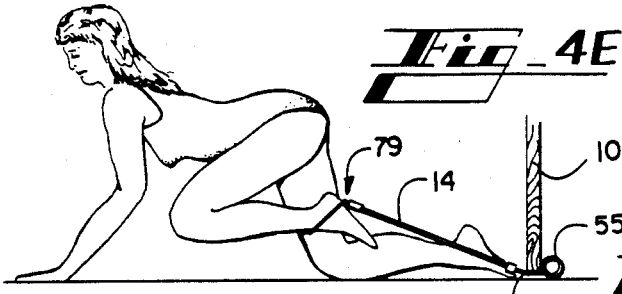
FIG. 4E is a view illustrating use of the configuration shown in FIG. 3B of the disclosed embodiment of the present invention for use in exercising the thigh.

FIG. 4E illustrates the sprinter leg lift to exercise the thigh. The loop 85 of the foot strap 79 is secured around one ankle. The exerciser takes a sprinter start position with the leg extended behind. The leg is slowly pulled forward to the chest keeping the head and back straight. The leg is then slowly returned to the starting position.

Figure 4F:
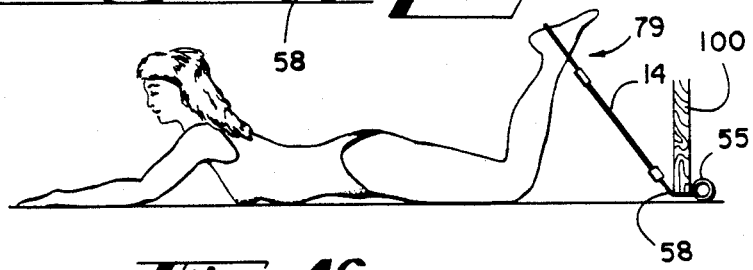
FIG. 4F is a view illustrating use of the configuration shown in FIG. 3B of the disclosed embodiment of the present invention for use in ham string or thigh exercise.

FIG. 4F illustrates the leg curl to exercise the hamstring or the back of the thigh. The exerciser places the ankles through the loops 85 of the foot strap 79 and lies prone on the stomach with the legs fully extended. The exerciser then slowly curls the leg forward to pull the heels toward the buttocks, stops, and then lowers the leg back to the starting position.

Other leg exercises (not illustrated) include the front and back kick for exercising the front and back of the thigh and buttocks. The exerciser secures the ankle through the loop 85 of the foot strap 79. Holding the chain for balance and facing away from the door, the exercise slowly extends the leg in front and returns slowly to the starting position. The exerciser then turns around and faces the door, slowly bringing the leg backwards and slowly returning to the starting position. Another exercise is the standing leg lift in which the exerciser slowly brings the knee to the chest and returns to the starting position. If necessary the exerciser uses a chair for balance and stands facing the door.

Figure 4G:
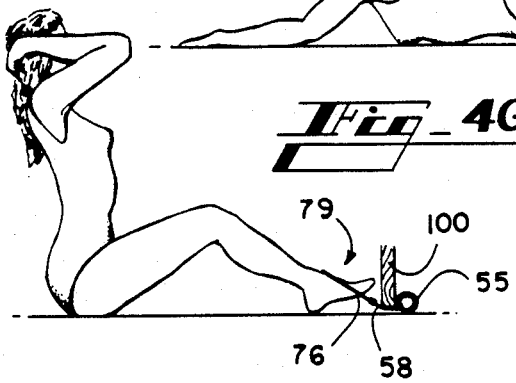
FIG. 4G is a view illustrating use of the configuration shown in FIG. 3C of the disclosed embodiment of the present invention for use in abdominal curl and bent knee situps.

Abdominal exercises may also be accomplished using the elastomeric exercise apparatus 10. Generally, these exercises are illustrated in FIGS. 4G, H, and I, and use the door stop 52 connected directly to the hand grip 22 or the foot strap 79. The door strap 52 is secured to the bottom of the door 100 as described above. FIG. 4G illustrates use of the apparatus for the abdominal curl or the bent knee sit-up exercise. To perform the abdominal curl, the exerciser lies on his back with the knees bent and feet placed flat on the floor. The arms are closed on the chest or behind the head. The exerciser slowly curls up, bringing only the head and shoulders slightly off the floor and then slowly returns to the starting position. For the bent knee sit-up, the exerciser takes a seated position with the legs bent and feet secured by the foot strap 79. The arms are crossed on the chest or behind the head. The exerciser slowly lowers into an approximately 45 degree angle with the floor and then slowly returns to the starting position.

Figure 4H:
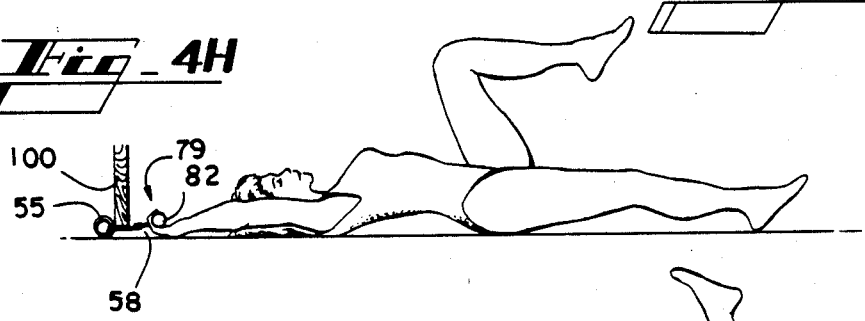
FIG. 4H is a view illustrating use of the configuration shown in FIG. 3C of the disclosed embodiment of the present invention for use in knee curl or bicycle exercise.

FIG. 4H illustrates the knee curl or bicycle exercise. The exerciser lies on his back with the arms extended and grasping the tubes 82 of the foot strap 79. The legs are held slightly off the floor. The exerciser slowly moves his knees in towards the chest and then slowly extends the legs back out in a continuous movement. For the bicycle exercise, the legs are pulled to the chest alternately similar to riding a bicycle.

Figure 4I:
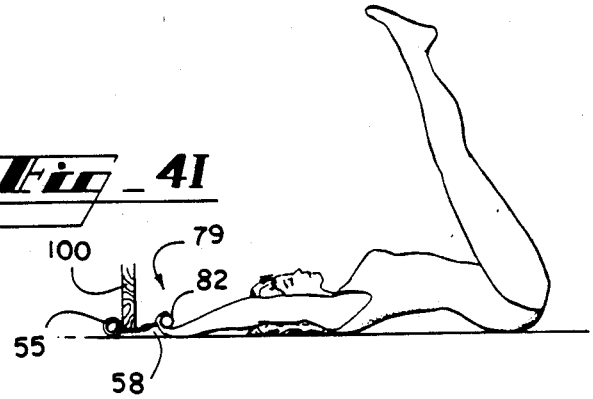
FIG. 4I is a view illustrating use of the configuration shown in FIG. 3C of the disclosed embodiment of the present invention for use in leg lift exercise.

FIG. 4I illustrates use of the apparatus 10 for a leg lift exercise. The exerciser lies on the floor with the arms extended behind the head towards the door. The hands grasp the tubes 82 of the strap 79. Holding the legs together and slightly off the floor, the exerciser slowly lifts both legs until perpendicular to the floor and then slowly returns to the starting position.

Not illustrated is the use of the apparatus configuration shown in FIG. 3A for side bend exercise of the abdominal muscles. This exercise requires the elastomeric loop 14 be connected between the door stop 52 and the hand grip 22. The door stop 52 is secured to the bottom of the door 100 and the exerciser stands with his side to the door and firmly grasps the hand grip 22. The exerciser slowly bends to the side and then straightens up. This exercise is repeated for the opposite side.

There has been thus described a lightweight exercise apparatus which may be conveniently and easily stored for travel and handling. Various components may be selectively connected together to form an exercise apparatus for working out specific muscles in the upper body, the abdomen, and the legs. Further, additional elastomeric loops 14 may be connected with the rings 16 and the snap buckles to increase the resistance provided by the exercise apparatus 10 of the present invention.

However, certain users interested in exercising selected muscles such as only the legs, the abdomen, or the upper body, may prefer to have a lightweight exercise apparatus according to the present invention with the appropriate elastomeric loop, the holding grip or straps, and the door stop fixedly connected together. In this disclosed alternate embodiment of the present invention, the rings 16 are not included on the elastomeric loop 14 nor are the snap buckles 49, 73, and 91 included on the hand grip 22, the door stop 52, and the foot strap 79, respectively. Rather, the ends of the woven ribbon for these components join together forming loops. A small loop where the ends connect together wraps over the elastomeric tube to fixedly attach the accessor components together.

Figures 5A, 5B, 5C, 5D:
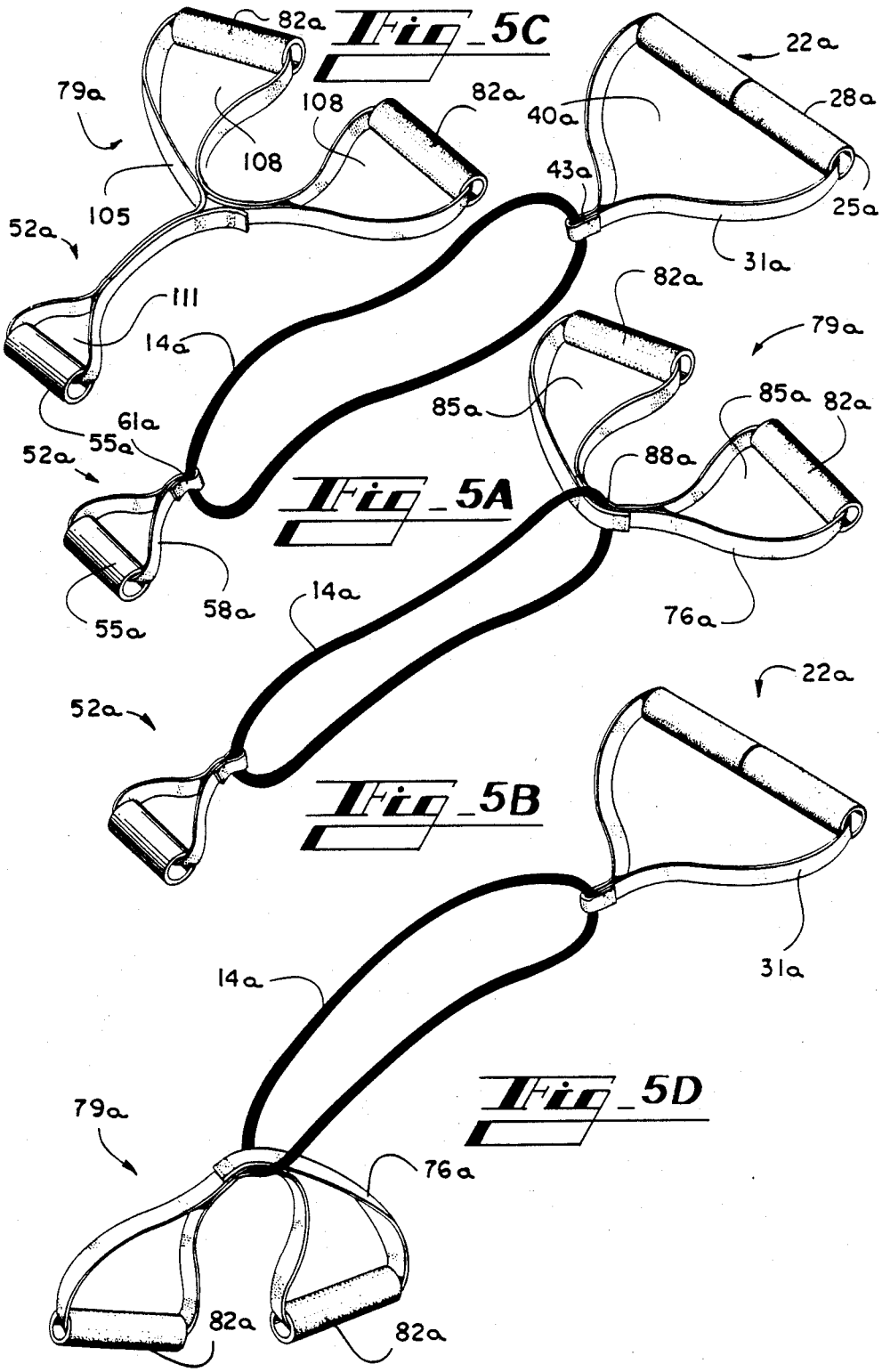
FIG. 5A is a perspective view of an alternate disclosed embodiment of the elastomeric exercise apparatus according to the present invention, having a fixed configuration of the door stop, the elastomeric loop, and the hand grip.
FIG. 5B is a perspective view of an alternate disclosed embodiment of the elastomeric exercise apparatus according to the present invention, shown in an alternate fixed configuration having the door stop, the elastomeric loop, and the foot strap.
FIG. 5C is a perspective view of an alternate disclosed embodiment of the exercise apparatus according to the present invention, shown with the door stop and the foot strap in an alternate fixed configuration.
FIG. 5D is a perspective view of an alternate disclosed embodiment of the elastomeric exercise apparatus, showing the foot strap, an elastomeric loop, and the hand grip in an alternate fixed configuration.

FIG. 5A illustrates in perspective view an elastomeric exercise apparatus according to the present invention in which the hand grip 22a, the elastomeric loop 14a, and the door stop 52*a* are assembled together in a fixed configuration. The ends of the woven fabric 31*a* are connected together to form a first loop 40*a* and a smaller second loop 43*a*. The first loop 40*a* receives the rigid tube 25*a* while the second loop 43*a* wraps over the elastomeric loop to fix the grip 22*a* to the elastomeric loop 14*a*. The door stop 52*a* as previously described includes a woven fabric ribbon 58a with its ends connected together to form two loops. The larger loop receives the rigid tube 55*a* while one end 61*a* of the ribbon 58*a* wraps the the elastomeric loop 14*a* whereby the door stop 52*a* is fixed to over elastomeric loop 14*a*.

FIG. 5B illustrates in perspective view an alternate disclosed embodiment of the elastomeric exercise apparatus having the door stop 52*a*, the elastomeric loop 14*a* and the foot strap 79*a* connected together. The door stop 52a connects to the elastomeric loop 14*a* as discussed above. The foot strap 79*a* includes the woven fabric ribbon 76*a* connected together at its ends to define the two large loops 85*a*. Each large loop receives one of the two resilient tubes 82*a*. A smaller loop 88*a* defined by the connection of the ends of the fabric ribbon wraps over the elastomeric loop 14*a* to fix the foot strap 79*a* to the elastomeric loop 14*a*.

FIG. 5C illustrates in perspective view an alternate disclosed embodiment of the exercise apparatus according to the present invention using the door stops 52*a* and the foot strap 79*a* in fixed configuration. This embodiment uses a woven fabric ribbon 105 having its ends connected together adjacent an intermediate section of the ribbon 105 to define two large loops 108 and a third loop 111. Each large loop receives one resilient tube 82 while the third loop receives the rigid tube 55*a*.

FIG. 5D illustrates a perspective view of an alternate disclosed embodiment of the elastomeric exercise apparatus having the foot strap 79*a*, the elastomeric loop 14*a*, and the hand grip 22*a* in a fixed configuration. The fabric ribbon 76*a* and 31*a* in the foot strap 79*a* and the hand grip 22a each include a loop which wraps over the elastomeric loop 14*a* to fix the foot strap 79*a* and the hand grip 22*a* to the elastomeric loop 14*a*.

Figure 6:
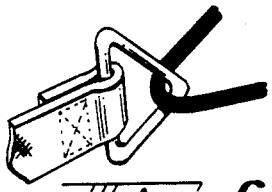
FIG. 6 is a perspective view of an alternate fixed connection between the elastomeric loop and the fabric ribbon for the door stop, the hand grip, and the foot strap.

FIG. 6 is a perspective view of an alternate connector between the elastomeric loop 14*a* and the fabric ribbon for the hand grip, the door stop, and the foot strap, for example 31*a*. This connector uses a triangular ring 114 which connects to the loop defined by the connected ends of the woven fabric ribbons. The triangular connector 114 threads on the elastomeric tube 13 prior to forming the loop 14 as discussed above.

These alternate disclosed embodiments having the fixed assembled configurations of the elastomeric loop 14*a*, the hand grip 22*a*, the door stop 52*a*, and the foots trap 79*a* may be used for exercising specific muscles in the upper back, the abdomen, or the legs as discussed above in association with FIGS. 4A–I. The detailed discussion for each such exercise illustrated in FIGS. 4A–I may be applied for the disclosed embodiments of the invention illustrated in FIGS. 5A–D by one reading this disclosure or by one of ordinary skill in the art. For instance, the configuration of FIG. 5A may be used for the exercises illustrated in FIGS. 4B and 4C. The apparatus shown in FIG. 5B may be used for the exercises illustrated in FIGS. 4D, E, and F. The apparatus of FIG. 5C may be used for the exercises illustrated in FIGS. 4G, H, and I. The apparatus of FIG. 5D may be used for the exercise illustrated in FIG. 4A as discussed above.

The principles, preferred embodiments and modes of operation of the present invention have been described in the foregoing specification. The invention is not to be construed as limited to the particular forms disclosed, because these are regarded as illustrative rather than restrictive. Moreover, variations and changes may be made by those skilled in the art without departing from the spirit of the invention as described by the following claims.

What is claimed is:

1. An exercise apparatus, comprising:
a closed elastomeric loop;
at least two ring threaded on the elastomeric loop;
a grip comprising:
an elongate rigid tube;
a first woven fabric ribbon threaded through the tube and having a first end connected to a second end to form at least one first loop and a smaller second loop;
at least one foam tube received on the exterior of the elongate rigid tube;
and
a first snap buckle connected to the second loop; and
a door stop comprising:
a second rigid tube;
a second woven fabric ribbon threaded through the second rigid tube, a first end of the second ribbon connected to a second end of the second ribbon to form a third loop and a smaller fourth loop; and
a second snap buckle received by the fourth loop;
the first and second snap buckle being selectively connectable to the rings on the elastomeric loop so that the exercise apparatus may be selectively assembled and disassembled.

2. An exercise apparatus as recited in claim 1 wherein the elastomeric loop is defined by bonding a first end of an elastomeric tube to a second end of the elastomeric tube.

3. The exercise apparatus as recited in claim 1 further comprising a rigid joiner tube which receives a first end and a second end of an elastomeric tube whereby the elastomeric loop is defined by the connection of the first end and the second tube, the rigid joiner tube having an outer diameter greater than the outer diameter of the elastomeric tube.

4. The exercise apparatus as recited in claim 1 wherein each ring is substantially rectangular and includes two parallel long members joined at the ends by two parallel short members.

5. The exercise apparatus as recited in claim 4 wherein the gap between the two long members is less than the diameter of the elongate elastomeric tube.

6. The exercise apparatus as recited in claim 1, further comprising a foot strap comprising:
two resilient tubes;
a third woven fabric ribbon connected together to define
two large loops, each large loop receiving one of the two resilient tubes, and a smaller fifth loop; and a third snap buckle received by the fifth loop.

7. An exercise apparatus, comprising:

a closed elastomeric loop;

a grip comprising:

an elongate rigid tube;

a first woven fabric ribbon having a first end connected to a second end to form a first loop and a smaller second loop, the rigid tube threaded on the first loop, the second loop wrapped over the elastomeric loop whereby the grip is fixed to the elastomeric loop; and at least one foam tube received on the exterior of the elongate rigid tube; and a door stop comprising:

a second rigid tube;

a second woven fabric ribbon having a third end connected to a fourth end to form a third loop and a smaller fourth loop, the second rigid tube threaded on the third loop, the fourth loop wrapped over the elastomeric loop whereby the door stop is fixed to the elastomeric loop.

8. An exercise apparatus as recited in claim 7 wherein the elastomeric loop is defined by bonding a first end of an elastomeric tube to a second end of the elastomeric tube.

9. The exercise apparatus as recited in claim 7 further comprising a rigid joiner tube which receives a first end and a second end of an elastomeric tube whereby the elastomeric loop is defined by the connection of the first end and the second tube, the rigid joiner tube having an outer diameter greater than the outer diameter of the elastomeric tube.

10. An exercise apparatus, comprising:

a closed elastomeric loop;

a foot strap, comprising:

two resilient tubes; and a woven fabric ribbon connected together to define two large loops, each large loop receiving one of the two resilient tubes, and a smaller fifth loop wrapped over the elastomeric loop whereby the foot strap is fixed to the elastomeric loop; and a door stop comprising:

a second rigid tube;

a second woven fabric ribbon having a third end connected to a fourth end to form a third loop and a smaller fourth loop, the second rigid tube threaded on the third loop, the fourth loop wrapped over the elastomeric loop whereby the door stop is fixed to the elastomeric loop.

11. An exercise apparatus, comprising:

a closed elastomeric loop;

a grip comprising:

an elongate rigid tube;

a first woven fabric ribbon having a first end connected to a second end to form a first loop and a smaller second loop, the rigid tube threaded on the first loop, the second loop wrapped over the elastomeric loop whereby the grip is fixed to the elastomeric loop; and at least one foam tube received on the exterior of the elongate rigid tube; and a foot strap, comprising:

two resilient tubes; and a woven fabric ribbon connected together to define two large loops, each large loop receiving one of the two resilient tubes, and a smaller fifth loop wrapped fixed to the elastomeric loop.

* * * * *